US011222533B2

(12) United States Patent
Sorgatz

(10) Patent No.: US 11,222,533 B2
(45) Date of Patent: Jan. 11, 2022

(54) DEVICE AND METHOD FOR A DRIVING ASSISTANCE SYSTEM FOR A VEHICLE AND DEVICE AND METHOD FOR A CONTROL ENTITY FOR A CONTROLLABLE ROAD SIGN

(71) Applicant: VOLKSWAGEN AKTIENGESELLSCHAFT, Wolfsburg (DE)

(72) Inventor: Stephan Sorgatz, Magdeburg (DE)

(73) Assignee: VOLKSWAGEN AKTIENGESELLSCHAFT, Wolfsburg (DE)

( * ) Notice: Subject to any disclaimer, the term of this patent is extended or adjusted under 35 U.S.C. 154(b) by 0 days.

(21) Appl. No.: 15/764,805

(22) PCT Filed: Oct. 4, 2016

(86) PCT No.: PCT/EP2016/073699
§ 371 (c)(1),
(2) Date: Mar. 29, 2018

(87) PCT Pub. No.: WO2017/060256
PCT Pub. Date: Apr. 13, 2017

(65) Prior Publication Data

US 2018/0286227 A1 Oct. 4, 2018

(30) Foreign Application Priority Data

Oct. 7, 2015 (DE) ..... 10 2015 012 932.5
Dec. 17, 2015 (DE) ..... 10 2015 016 349.3

(51) Int. Cl.
*G08G 1/08* (2006.01)
*G08G 1/01* (2006.01)
(Continued)

(52) U.S. Cl.
CPC ..... *G08G 1/08* (2013.01); *G08G 1/0112* (2013.01); *G08G 1/0133* (2013.01);
(Continued)

(58) Field of Classification Search
CPC .. G08G 1/0112; G08G 1/0133; G08G 1/0145; G08G 1/08; G08G 1/09626;
(Continued)

(56) References Cited

U.S. PATENT DOCUMENTS 7,038,596 B2 5/2006 Nakajima
8,401,758 B2 3/2013 Stählin et al.
(Continued)

FOREIGN PATENT DOCUMENTS

CN 1573730 A 2/2005
CN 101911144 A 12/2010
(Continued)

OTHER PUBLICATIONS

Dresner et al.; A Reservation-Based Multiagent System for Intersection Control; The 5th IFAC Symposium on Intelligent Autonomous Vehicles; 2004.
(Continued)

*Primary Examiner* — Quan-Zhen Wang
*Assistant Examiner* — Rajsheed O Black-Childress
(74) *Attorney, Agent, or Firm* — Barnes & Thornburg LLP

(57) ABSTRACT

A device for a driving assistance system for a transportation vehicle including a control unit to detect information concerning a position of a controllable road sign. The control unit detects information concerning the position of the transportation vehicle and determines information concerning at least one expected passing time, at which the transportation vehicle passes the controllable road sign, based on the information concerning the position of the transportation
(Continued)

vehicle and the information concerning the position of the controllable road sign. The device also includes a receiving and transmitting unit to provide the information concerning the expected passing time at which the transportation vehicle passes the controllable road sign, to a control entity for the controllable road sign. The receiving and transmitting device receives information from the control entity concerning a period of time in which the controllable road sign is passable.

10 Claims, 5 Drawing Sheets

(51) Int. Cl.
*G08G 1/0967* (2006.01)
*G08G 1/0962* (2006.01)

(52) U.S. Cl.
CPC ..... *G08G 1/0145* (2013.01); *G08G 1/09626* (2013.01); *G08G 1/096716* (2013.01); *G08G 1/096725* (2013.01); *G08G 1/096758* (2013.01); *G08G 1/096783* (2013.01)

(58) Field of Classification Search
CPC ..... G08G 1/096716; G08G 1/096725; G08G 1/096758; G08G 1/096783
See application file for complete search history.

(56) References Cited

U.S. PATENT DOCUMENTS

| | | | | |
|---|---|---|---|---|
| 8,560,200 | B2 | 10/2013 | Maruyama | |
| 10,916,133 | B2 | 2/2021 | Bradai et al. | |
| 2001/0050620 | A1* | 12/2001 | Lee | G08G 1/087 340/905 |
| 2002/0102961 | A1* | 8/2002 | Gibbons | G08G 1/0965 455/404.2 |
| 2007/0198169 | A1* | 8/2007 | Nathan | G08G 1/096716 701/117 |
| 2010/0284382 | A1* | 11/2010 | Stahlin | G08G 1/04 370/338 |
| 2011/0018701 | A1 | 1/2011 | Mizuno | |
| 2012/0274481 | A1 | 11/2012 | Ginsberg et al. | |
| 2013/0013179 | A1 | 1/2013 | Lection et al. | |
| 2014/0046581 | A1* | 2/2014 | Ota | G08G 1/096716 701/408 |
| 2015/0109147 | A1* | 4/2015 | Stahlin | G08G 1/017 340/907 |

FOREIGN PATENT DOCUMENTS

| | | | |
|---|---|---|---|
| CN | 102729997 | A | 10/2012 |
| CN | 103500508 | A | 1/2014 |
| CN | 107209988 | A | 9/2017 |
| DE | 102008035992 | A1 | 3/2009 |
| DE | 102010052702 | A1 | 5/2012 |
| DE | 102012006708 | A1 | 10/2012 |
| DE | 102011081609 | A1 | 2/2013 |
| DE | 102012210069 | A1 | 12/2013 |
| DE | 112012001799 | T5 | 1/2014 |
| DE | 102012214164 | B3 | 4/2014 |
| DE | 102012014281 | A1 | 5/2014 |
| DE | 102013101405 | A1 | 8/2014 |
| EP | 1162585 | A1 | 12/2001 |
| GB | 2421829 | A | 7/2006 |
| TW | 201411544 | A | 3/2014 |

OTHER PUBLICATIONS

Vanmiddlesworth et al.; Replacing the Stop Sign: Unmanaged Intersection Control for Autonomous Vehicles; 7th International Joint Conference on Autonomous Agents and Multiagent Systems; 2008.

Search Report for German Patent Application No. 10 2015 016 349.3; dated Jul. 14, 2016.

Search Report for International Patent Application No. PCT/EP2016/073699; dated Jan. 19, 2017.

Office Action for Chinese Patent Application No. 201680071627.3; dated Jul. 30, 2020.

* cited by examiner

DEVICE AND METHOD FOR A DRIVING ASSISTANCE SYSTEM FOR A VEHICLE AND DEVICE AND METHOD FOR A CONTROL ENTITY FOR A CONTROLLABLE ROAD SIGN

PRIORITY CLAIM

This patent application is a U.S. National Phase of International Patent Application No. PCT/EP2016/073699, filed 4 Oct. 2016, which claims priority to German Patent Application Nos. 10 2015 012 932.5, filed 7 Oct. 2015, and 10 2015 016 349.3, filed 17 Dec. 2015, the disclosures of which are incorporated herein by reference in their entireties.

SUMMARY

Illustrative embodiments relate to a device and a method for a driving assistance system for a transportation vehicle and to a device and a method for a control entity for a controllable road sign.

BRIEF DESCRIPTION OF THE DRAWINGS

Disclosed embodiments are described in detail below based on the drawings, to which exemplary embodiments are not generally limited. Shown are.

DETAILED DESCRIPTION

Figure 1:
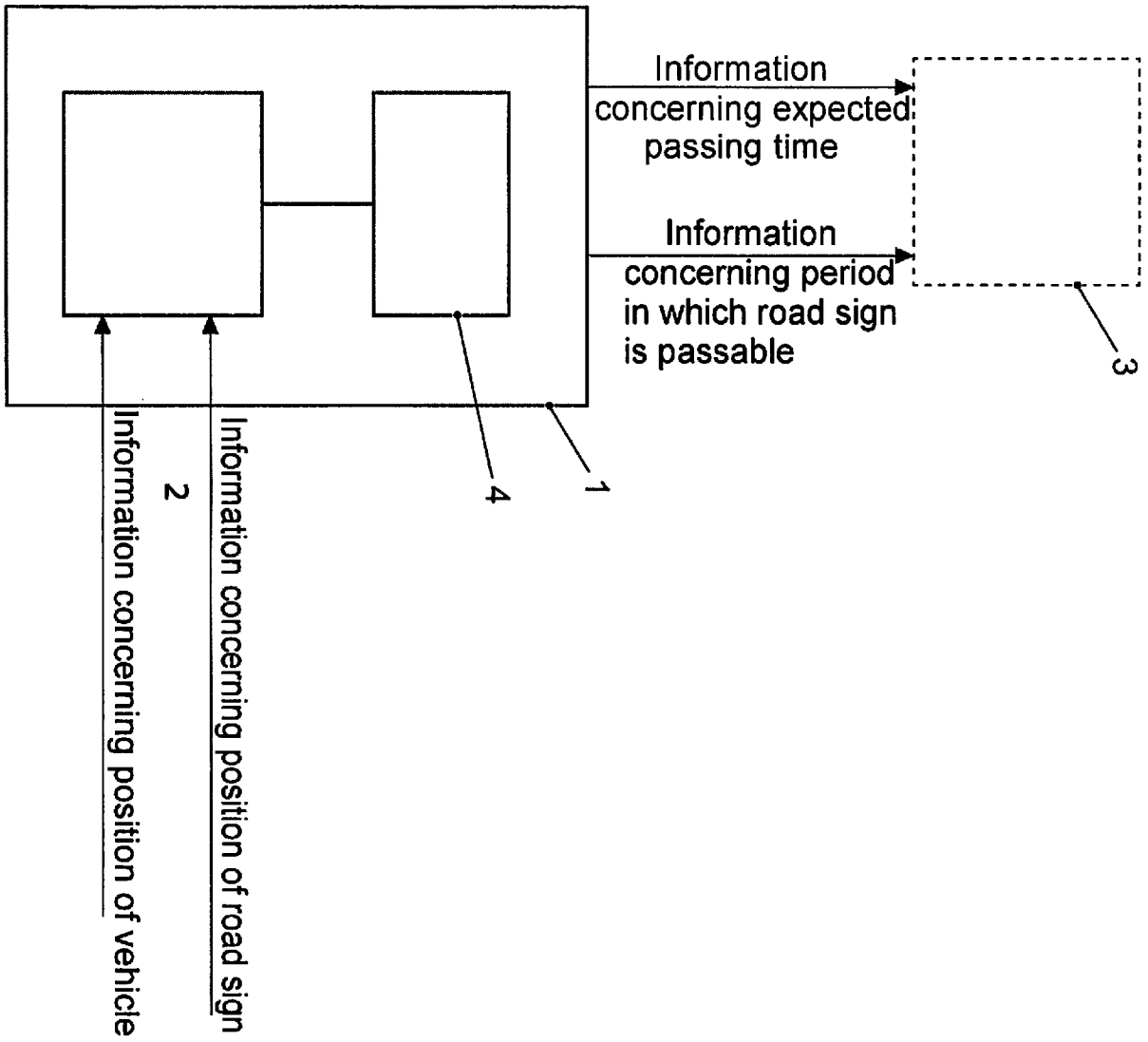
FIG. 1 shows a schematic representation of a device for a driving assistance system for a transportation vehicle.

Traffic lights as a controllable traffic road sign, for example, at traffic-light controlled intersections, can represent bottlenecks in the traffic system and are a significant factor in the quality of traffic flow. To increase a flow of traffic, structural measures, especially in inner cities, are usually only possible to a limited extent.

Conventionally, at traffic-light controlled junctions two separate systems are usually observed, namely the set of traffic lights and the transportation vehicle. Especially in the area of the traffic light conventional systems are already used, which are intended to generate knowledge to improve current traffic conditions and the switching times of the traffic light so that the traffic flow is enhanced. For example, these could involve detectors in a traffic lane. However, conventional traffic lights at intersections are usually severely limited in their switching behavior. In addition, conventional transportation vehicles usually have no facilities for obtaining information on the switching behavior of the traffic light ahead of time, to enable a driving strategy to be adapted to suit the switching behavior in advance. By using a radio-based communication it may be possible to exchange information between the two systems, traffic lights and transportation vehicle, and to optimize a common objective function "Traffic flow increase". In some conventional systems for traffic flow improvement, a driver is informed about a present state of the traffic light and possible impending switching times using wireless technologies, such as mobile radio or WLAN. As a result, a static speed recommendation can then be provided to the driver. This is used, for example, to assist the objective of supporting the driver and to avoid stops at traffic-light controlled intersections, such as in the projects KOLINE http:/www.projekt-koline or KOLIBRI http:/www.kolibri-project.de.

Furthermore, in some conventional systems detectors are used in the highway, which can detect transportation vehicles. With this information, traffic light systems can adapt their signal phases to the current traffic, within certain limits. Such systems are proposed, for example, by Van-Middlesworth, Dresner and Stone in the article "Replacing the stop sign. Unmanaged intersection control for autonomous vehicles", which appeared in 2008 in the Proceedings of the "7th international joint Conference on Autonomous agents and multi-agent systems". The article is based on the 2004 article "A reservation-based multi-agent system for intersection control" by Dresner and Stone. A version can be found in the proceedings of the "5th IFAC Symposium on Intelligent Autonomous Vehicles". In terms of content, the authors propose a system based on a wireless communication of transportation vehicles with one another and/or with the traffic light. Each individual transportation vehicle at each operation queries the traffic light or the other transportation vehicles whether it can cross the intersection at its preferred time. In response it receives an answer "Yes" or "No". In the case of "Yes" in the next operation the transportation vehicle accelerates with maximum acceleration, without exceeding its maximum speed. In the case of "No", in the next operation the transportation vehicle slows down with maximum deceleration. Under unfavorable conditions, this does not allow an optimum traffic flow to be achieved. In addition, due to alternate acceleration and deceleration this strategy can also result in an extremely uncomfortable driving behavior.

There is therefore a need to provide an improved approach to enhancing traffic flow, in particular, in the area of road signs. This need is satisfied by devices and methods in accordance with the independent claims.

Exemplary embodiments relate to a device for a driving assistance system, for example, for a transportation vehicle, with a control device which is designed to determine information concerning a position of a controllable road sign. The control unit is additionally designed to determine information concerning a position of the transportation vehicle. The control unit is also designed to identify information concerning at least one expected passing time at which the transportation vehicle passes the controllable road sign. The information involved is determined based on the information concerning the position of the transportation vehicle and the information concerning the position of the controllable road sign. The device also comprises a receiving and transmitting device. The receiving and transmitting device is designed to supply the information concerning the expected passing time, at which the transportation vehicle will pass the controllable road sign, to a control entity for the controllable road sign. The receiving and transmitting device is also designed to receive information from the control entity concerning a period of time in which the controllable road sign can be passed. In some exemplary embodiments, the fact that the control entity outputs a time period in which the road sign is passable allows a driving behavior of the transportation vehicle to be better adapted to a switching behavior of the road sign. The fact that a forecast is issued by the transportation vehicle relating to an estimated or desired time of passage means that in some embodiments the period in which the road sign is passable can be adjusted to suit the expected passing time, and/or a traffic volume determined or estimated in this way can be input into the switching times of the controllable road sign.

As an addition, the control device can be designed to determine information concerning a speed and/or information concerning an acceleration of the transportation vehicle. The control device can then be designed to determine the information concerning the expected passing time based on the information concerning the speed and/or based on the information concerning the acceleration of the transportation vehicle. In some exemplary embodiments this enables the passing time to be estimated more accurately.

As an addition or alternatively, the control device can be designed to determine information concerning a planned route of the transportation vehicle, and to determine the information concerning the expected passing time, based on the information concerning the planned route. In some exemplary embodiments the expected passing time can therefore be estimated more simply. The expected passing time may be, for example, an estimate or a prediction. For example, the information concerning the planned route of the transportation vehicle can be supplied by a navigation device for the transportation vehicle. Under certain circumstances, along with the expected passing time further information concerning a planned route of the transportation vehicle can also be provided to the control entity, for example, a direction indication such as turn left, drive straight ahead, turn right, or the like.

In addition, or alternatively, the control device can be designed to determine information concerning a speed and/or information concerning an acceleration of at least one transportation vehicle driving directly ahead. The control device can then be designed to determine the information concerning the expected passing time based on the information concerning the speed and/or based on the information about the acceleration of the transportation vehicle directly ahead. In some exemplary embodiments this enables the passing time to be estimated more accurately. In other words, in some exemplary embodiments still further information can be used to estimate the passing time, for example, values that relate to a transportation vehicle travelling directly ahead, such as its speed, acceleration or a distance from this transportation vehicle. This allows the determination of the expected passing period in some exemplary embodiments to be even further improved.

In some exemplary embodiments, the control device can be designed to output information concerning a driving instruction. In this case the information concerning the driving instruction specifies how a driving behavior of the transportation vehicle should be adjusted for it to pass through the controllable road sign within the time period. The information can be determined, for example, based on the information concerning the period in which the controllable road sign is passable. In some exemplary embodiments this means that a driving behavior of the transportation vehicle, for example, in relation to starting, stopping, a speed and/or the like, can be influenced in such a way that the road sign can be passed without further stopping or with as few additional stopping operations as possible. In general, exemplary embodiments can allow the possibility of improving the traffic flow.

In addition, the information concerning the driving instruction can be supplied so that an interface outputs the information for a user. In some exemplary embodiments, the fact that the user receives the information as to how he/she can adapt their driving behavior means that he/she will pass the road sign within the time period. The display for a user can be, for example, in visual form on a display surface and/or in audible form.

In addition, or alternatively, the information concerning the driving instruction can also be made available in such a way that a drive train of the transportation vehicle is activated in such a way that the transportation vehicle passes the controllable road sign within the time period. In some exemplary embodiments, an automatic control of the driving behavior of the transportation vehicle may enable a number of stopping and starting operations to be reduced. This can enable the fuel consumption and/or transportation vehicle emissions to be reduced. This can include not only issuing a speed recommendation, but possibly also exerting a direct influence on a speed of the transportation vehicle without involving a driver of the transportation vehicle. For example, the driving instruction can also be implemented automatically using a longitudinal control. In some exemplary embodiments not only can a constant speed be calculated or determined, but an optimal or an improved driving instruction, which possibly comprises different speeds, can be issued. If possible, a speed at which the transportation vehicle passes the road sign, for example, crossing speed of the transportation vehicle through a traffic-light controlled intersection, can be maximized or improved, or else made to correspond to a desired speed of a driver of the transportation vehicle.

The control device in some exemplary embodiments is designed to update the passing time. In some exemplary embodiments, the fact that the process outlined here can be repeated means that the determination of the time period can be based on up to date or recurrently updated traffic data. Changes in a traffic volume and/or a driving behavior of the transportation vehicle can be quickly taken into account. The passing time can be repeated or updated multiple times per second in some cases.

Exemplary embodiments relate to a device for a control entity for a controllable road sign. The device comprises a control device, which is designed to obtain information concerning at least one expected passing time, at which at least one transportation vehicle wants to pass through the controllable road sign. The control entity is also designed to determine and supply information concerning a time period in which the controllable road sign is passable. In some exemplary embodiments, the fact that the transportation vehicle registers with the control entity by communicating the desired passing time, means that a higher accuracy can be achieved than in systems in which transportation vehicles are detected by detectors in the traffic lane. In addition, more data can be collected and switching times can be planned in advance. In addition, in some exemplary embodiments additional information or variables can then be communicated to the control entity, such as a turning intention, a desired speed of the driver and/or the like. In addition, in some embodiments the control entity can obtain or estimate an exact number of transportation vehicles that want to pass through the road sign, and not merely a value which is estimated or measured by detectors.

In addition, the time period in which the controllable road sign is passable can be determined based on the information concerning the at least one expected passing time. In some exemplary embodiments the period of time can therefore be determined such that a transportation vehicle can pass the road sign without stopping, or else with as few starting and stopping operations as possible.

In some exemplary embodiments the control device is designed to obtain information concerning at least one expected passing time from a multiplicity of transportation vehicles. In some exemplary embodiments this enables a switching time of the road sign to be adapted to a traffic volume.

The device for a control entity for a controllable road sign can in some exemplary embodiments comprise a receiving and transmitting device. The receiving and transmitting device is designed to receive the information concerning the at least one expected passing time using wireless data transmission.

In addition, or alternatively, the receiving and transmitting device can be designed to supply the time period in which the controllable road sign is passable using wireless data transmission. In some exemplary embodiments the result of this is to enable the device for the control entity for a controllable road sign to be arranged outside the transportation vehicle. For example, the device can be arranged at or near the road sign. In addition or alternatively, the device or the control entity can also be a higher-level control unit, which is arranged a distance away from the road sign, for example, more than 1 km, 10 km, 100 km away. For example, the communication can then also take place via a multiplicity of transportation vehicles that are located within a certain distance of the road sign, for example, in a kind of ad-hoc or multi-hop network which is formed by the transportation vehicles.

Exemplary embodiments also relate to a driving assistance system having at least one device for a driving assistance system for a transportation vehicle according to at least one of the described exemplary embodiments, and at least one device for a control entity for a controllable road sign according to at least one of the described exemplary embodiments. In some exemplary embodiments, by influencing the driving behavior of the transportation vehicle or individual road users, and possibly a controller of the signaling states of the infrastructure or controllable road sign on the basis of highly up-to-date data concerning the traffic in the area of the road sign, a traffic flow can be increased. Under certain circumstances, due to an optimized or improved driving manner of the road users, possibly in interaction with an optimized or improved switching behavior of the road sign, a traffic flow at the road sign can be increased and the number of stopping and starting operations can be reduced. In some exemplary embodiments, by the cooperation of the control entity of the road sign with the transportation vehicle using wireless communications, highly up-to-date data can be transmitted or exchanged from the transportation vehicle to the road sign and from the road sign to the transportation vehicle. The road sign may therefore potentially be in a position to improve the time period or release and closure periods even more in terms of traffic flow increase, than is possible using conventional detector systems. This can be possible, for example, because more detailed knowledge is available concerning a number and intentions of the transportation vehicles that are approaching the road sign. In some exemplary embodiments, based on the information concerning the time period, or release and closure periods provided by the control entity, the transportation vehicle in turn can plan its own crossing and if possible, implement it either partially or fully autonomously. Furthermore, in some exemplary embodiments realistic dynamics of the transportation vehicles can be taken into account in a trajectory calculation and/or a determination or calculation of the time period.

The exemplary embodiments also relate to a method for a driving assistance system for a transportation vehicle. As part of the method, information concerning a position of a controllable road sign is determined. Information concerning a position of the transportation vehicle is also determined. Based on these information items, information is also determined concerning at least one expected passing time at which the transportation vehicle will pass the controllable road sign. In addition, the information concerning the expected passing time, at which the transportation vehicle will pass the controllable road sign, is supplied to a control entity for the controllable road sign. An information item supplied by the control entity concerning a time period in which the controllable road sign is passable is received.

Exemplary embodiments also relate to a method for a control entity for a controllable road sign. Information is determined concerning at least one expected passing time at which at least one transportation vehicle wants to pass through the controllable road sign. Then, information concerning a time period is determined in which the controllable road sign can be passed. The information is also supplied. The individual operations of the method can be carried out in the above sequences and/or partially or completely overlap.

Exemplary embodiments also create a program with a program code for implementing at least one of the above methods when the program code is executed on a computer, a processor, a control module or a programmable hardware component.

In general, exemplary embodiments can be implemented as software, firmware, computer program or computer program product with a program code or as data, wherein the program code is, or the data are, effective in terms of carrying out one of the methods if the program is running on a processor or a programmable hardware component. The program code or the data can also be stored, for example, on a machine-readable medium or data carrier. The program code or the data can exist as source code, machine code or byte code, among other things, as well as other intermediate code.

In the following description of the attached figures, which only show some exemplary examples, the same reference numerals can be used to designate identical or equivalent components. In addition, collective reference numerals can be used for components and objects, which occur multiple times in at least one exemplary embodiment or in a drawing, but which are described together in relation to one or more features. Components or objects described with the same or collective reference numerals can be embodied in the same way in terms of individual, multiple or all features, for example, in terms of their dimensions, but may also be embodied differently, unless otherwise explicitly or implicitly given by the description.

In the following description of the attached drawings, which show exemplary embodiments, the same reference numerals can be used to designate identical or equivalent components. In addition, collective reference numerals are used for components and objects which occur multiple times in at least one exemplary embodiment or in a drawing, but which are described together in relation to one or more features. Components or objects described with the same or collective reference numerals can be embodied in the same way in terms of individual, multiple or all features, for example, in terms of their dimensions, but may also be embodied differently, unless otherwise explicitly or implicitly given by the description.

Although exemplary embodiments can be modified and amended in different ways, the exemplary embodiments shown in the figures are examples and are described in detail herein. It should, however, be made clear that it is not intended to restrict exemplary embodiments to the disclosed forms, but that instead exemplary embodiments should cover functional and/or structural modifications, equivalents and alternatives which lie within the field of the disclosure. Identical reference numerals designate the same or similar elements throughout the description of the figures.

It is important to note that for any element, which is designated as being "connected" or "coupled" to any other element, it can either be directly connected or coupled to the other element or else intervening elements may be present. If on the other hand, an element is designated as being "directly connected" or "directly coupled" to another element, then there are no intervening elements present. Other terms used to describe the relationship between elements should be interpreted in a similar way (e.g., "between" compared to "directly between", "adjacent" compared to "directly adjacent", etc.).

The terminology used herein is used only for the description of certain exemplary embodiments and is not intended to restrict the exemplary embodiments. As used herein, the singular forms "a" and "an" and "the/this" are also meant to include the plural forms, unless the context clearly indicates otherwise. In addition, it should be clarified that the expressions such as "contains", "containing", "has" and/or "having" as used herein, indicate the presence of cited features, whole numbers, operations, work processes, elements and/or components, but do not exclude the presence or addition of one more or one or a plurality of features, whole numbers, operations, work processes, elements, components and/or groups thereof.

Unless otherwise defined, all of the terms used herein (including technical and scientific terms) have the same meanings as would be ascribed to them by an average person skilled in the art in the field to which the exemplary embodiments belong. It should also be clarified that expressions such as those that are defined in commonly used dictionaries, are to be interpreted as if they had the meaning consistent with their meaning in the context of the relevant technology, and should not be interpreted in an idealized or overly formal sense, unless this is expressly defined herein.

FIG. 1 shows a schematic representation of a device 1 for a driving assistance system for a transportation vehicle according to an exemplary embodiment. Exemplary embodiments also create a driving assistance system with a device 1. The device 1 comprises a control device 2. The control device 2 can be, for example, any device which is designed to process at least one of the information items or signals mentioned below. The control devices described herein can in this respect be implemented as a computer, processor or as programmable hardware components. In some exemplary embodiments, the control device can also be implemented as software or a computer program which performs a corresponding function when it is executed on a single processor, a computer or a programmable hardware component. A programmable hardware component can be formed by a processor, a computer processor (CPU=Central Processing Unit), a graphics processing unit (GPU=Graphics Processing Unit), a computer, a computer system, an application-specific integrated circuit (ASIC), an integrated circuit (IC), a single-chip system (SOC=System-on-Chip), a programmable logic element or a field-programmable gate array (FPGA) with a microprocessor.

The control device 2 is designed to determine information concerning a position of a controllable road sign. Here and in the following, an item of information can be represented by a signal, a value or a datum. For example, a signal can represent a binary, analog, digital or electrical value or an item of information that is represented by a value. In this respect, the information can be represented as a number or word wherein the position cannot then be represented based on an appropriate coordinate system, such as a map.

The controllable road sign can be, for example, any road sign whose status can be changed and/or which is designed to cause a transportation vehicle or other road user to interrupt their journey and to stop at the road sign, for example, a traffic light, a set of traffic lights, a signaling system, a light signal system, a barrier or such like. Information concerning the position of the road sign can be, for example, a location of the road sign. In addition, further information concerning the road sign, the traffic volume, waiting times can be transmitted, such as the nature of the stopping point, crossing, traffic-light intersection, railway crossing, tunnel entrance, for example, the intersection layout or other traffic point which is protected by the road sign. The information concerning a position of a controllable road sign can be determined, for example, by accessing the corresponding information from a memory, e.g., from a navigation device which navigates the transportation vehicle, or similar device. To this end the memory and/or navigation device can be coupled to the control device so that an information exchange is possible, for example, as signals. In addition, or alternatively, the control device 2 can also determine the position of the controllable road sign by having the sign receive information supplied by a control entity 3 for the controllable road sign. For example, the control entity 3 and the control device 2 can be coupled via wireless signal transmission, such as radio, W-LAN, mobile wireless or the like. In other words, the information concerning the position of the road sign can be stored in the road sign or in a device 5 assigned to the road sign, to be described in more detail later, and/or determined thereby, for example, by GPS. A transmitting device 7 of the device 5 can then be designed to supply the information about the position of the road sign.

The control device 2 is also designed to determine information concerning a position of the transportation vehicle. The information concerning a position of the transportation vehicle can be supplied, for example, using the navigation device that navigates the transportation vehicle or else a GPS sensor (abbr.: Global Positioning System) of the transportation vehicle. The memory, the navigation device and/or the GPS sensor can be linked to one another, for example, such that they can exchange signals. For example, the information concerning the position of the road sign can be provided and/or supplied by the road sign itself, for example, because it is stored there. The information can then be transmitted to the transportation vehicle, for example, by wireless communication.

The control unit 2 is additionally designed to identify at least one expected passing time, at which the transportation vehicle will pass the controllable road sign. The passing time can be an (estimated) predicted value, at which the transportation vehicle arrives at the road sign. The passing time can comprise a discrete time value or a time period. The passing time is identified based on the information concerning the position of the transportation vehicle and the information concerning the position of the controllable road sign.

In some embodiments, additional information can also be incorporated into the determination of the passing time, such as information concerning a current speed of the transportation vehicle and/or any other information, such as a position and/or a speed of at least one transportation vehicle driving ahead. For example, a radar sensor of the transportation vehicle can be used to determine the values of a transportation vehicle ahead, for example, a transportation vehicle driving directly in front.

The device 1 also comprises a receiving and transmitting device 4, which is coupled to the control device 4 and which is designed to supply the information of the expected passing time, at which the transportation vehicle will pass the controllable road sign, to the control entity 3 for the controllable road sign. The receiving and transmitting devices described herein in exemplary embodiments can include typical transmitter or receiver components. These include, for example, one or more antennas, one or more filters, one or more mixers, one or more amplifiers, one or more diplexers, one or more duplexers, etc. For example, in exemplary embodiments these can comprise at least one element of the group of WLAN communication module ("Wireless Local Area Network"), B BLUETOOTH® communication module, mobile radio communication module, UMTS communication module ("Universal Mobile Telecommunication System"), LTE communication module ("Long Term Evolution"), the communication module of a 5th generation mobile wireless network, near-field communication module and communication module for a cellular mobile wireless network. Supplying can mean, for example, sending or transmission to the control entity 3. The control entity 3 can be any device which is designed to control the controllable road sign, such as a programmable hardware component.

The receiving and transmitting device 4 is additionally designed to receive information from the control entity concerning a time period in which the controllable road sign is passable. The time period can be distinguished from a discrete time value or a response such as "yes" or "no" to a requested passing time. The time period can be, for example, at least 1 sec long. In addition, the time period can start at a defined point in time. Optionally, the time period can be defined by a time at which it starts and a time at which it ends.

Figure 2:
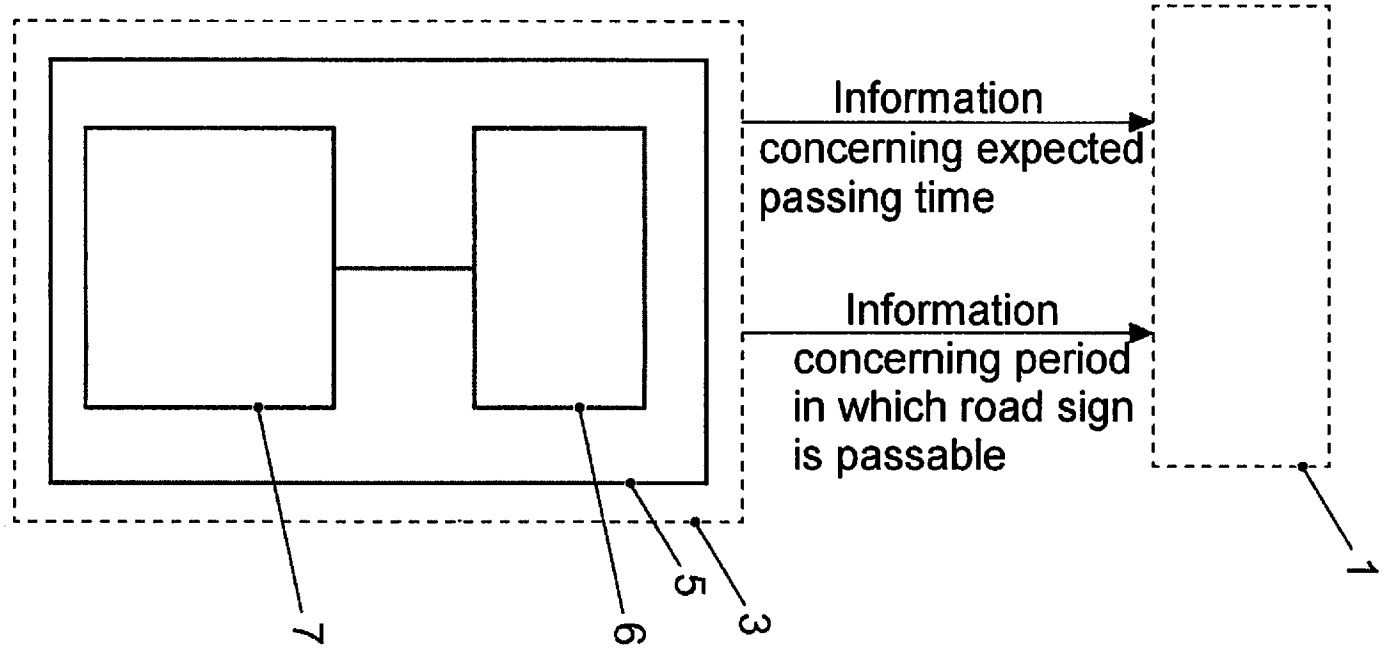
FIG. 2 shows a schematic representation of a device for a control entity for a controllable road sign.

FIG. 2 shows a schematic representation of a device 5 for a control entity 3 for a controllable road sign in accordance with an exemplary embodiment. The device 5 comprises a control device 6, which is designed to obtain information concerning at least one expected passing time at which at least one transportation vehicle wants to pass through the controllable road sign. In the exemplary embodiment of FIG. 2 the control entity 3 comprises the device 5.

Exemplary embodiments also create a control entity 3 having the device 5. The control device 6 can obtain the information concerning the expected passing time, for example, of from the device 1 of the transportation vehicle. The control device 6 is also designed to determine and supply information concerning a time period in which the controllable road sign is passable. The information can be supplied, for example, using a receiving and transmitting device 7, which is designed to receive the information concerning the at least one expected passing time using wireless data transmission and/or to supply the period in which the controllable road sign is passable using wireless data transmission. The receiving and transmitting device 7 and the control device 6 are coupled to each other.

Figure 3:
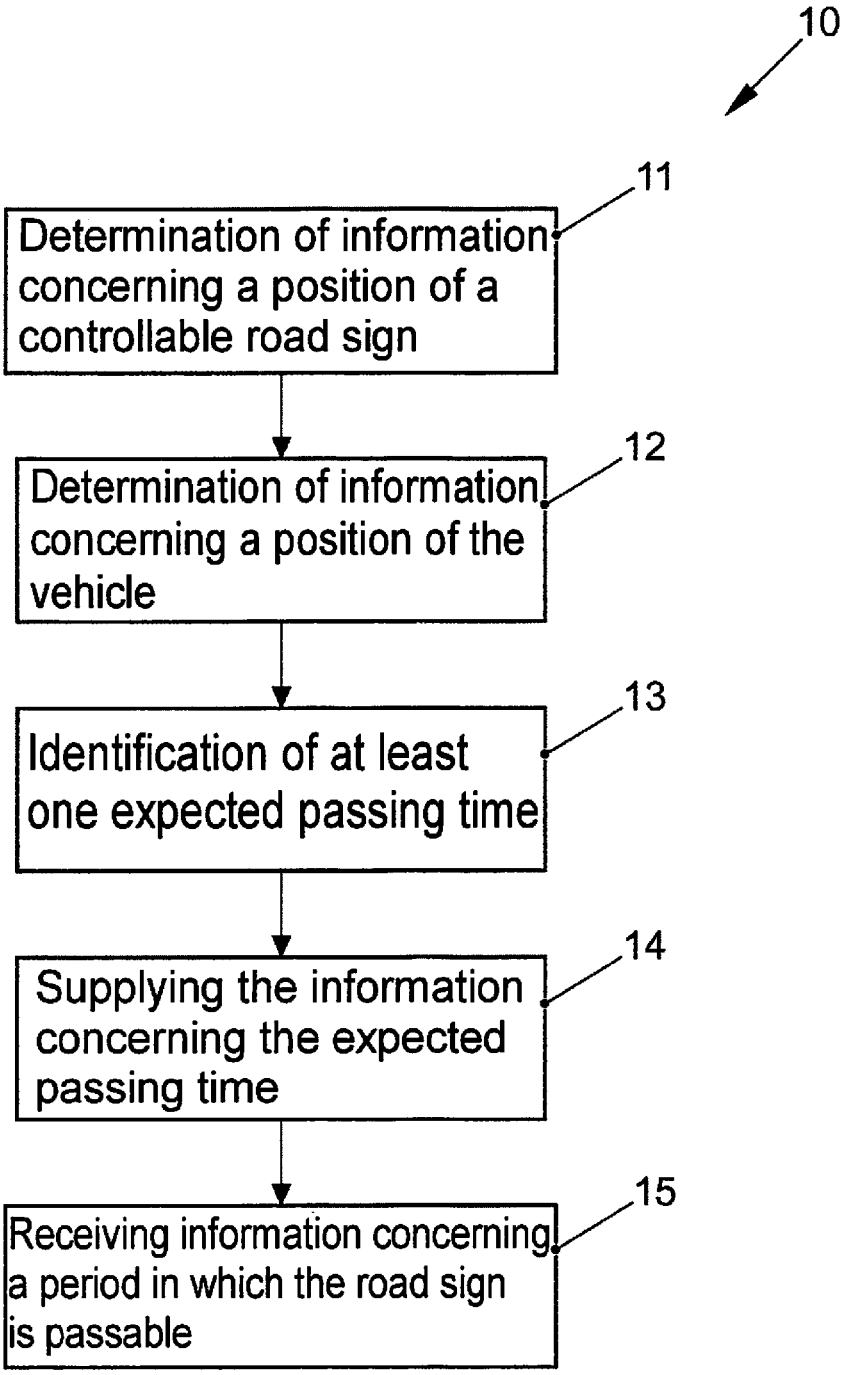
FIG. 3 shows a schematic representation of a method for a driving assistance system for a transportation vehicle.

FIG. 3 shows a schematic representation of a method 10 for a driving assistance system for a transportation vehicle according to an exemplary embodiment. In the method 10, in a first operation 11 a determination of information concerning a position of a controllable road sign is performed. For example, when the controllable road sign equipped with a required wireless technology is approached, a wireless communication with the transportation vehicle, which is also equipped with the wireless technology, is begun. In the first operation 11 the traffic light or the control entity of the road sign sends information to the transportation vehicle concerning a position of the road sign and if appropriate, concerning an intersection layout. In another exemplary embodiment the transportation vehicle initiates such a communication if it is detected that a controllable road sign is located on the route.

In a second operation 12, a determination of information concerning a position of the transportation vehicle is performed. For example, the transportation vehicle or its device 1, using its own built-in GPS positioning system, can now locate its position, for example, in relation to the road sign. This allows the device 1, among other things, to tell how far away the transportation vehicle is from the road sign and given a suitably accurate positioning system, possibly also the lane on which it is located.

In a further operation 13 at least one expected passing time is identified at which the transportation vehicle will pass the controllable road sign, based on the information concerning the position of the transportation vehicle and possibly information concerning its current speed and/or together with other possible variables and the information on the position of the controllable road sign. In other words, with this information and using its own desired speed the device 1 or the transportation vehicle can plan the time interval in which it would prefer to pass through the road sign, for example, a traffic-light intersection with traffic lights.

Then, in a further operation 14, information is supplied concerning the expected passing time at which the transportation vehicle will pass the controllable road sign for a control entity of the controllable road sign. For example, a planning interval or the passing time is sent to the traffic light using wireless technology.

In a subsequent process 15, information concerning a period in which the controllable road sign can be passed is received. This information is supplied by the control entity 3. In some exemplary embodiments, the scheduled release and closure periods of the traffic lights are communicated to all transportation vehicles that are currently in communication with the traffic lights. For this purpose the traffic light or road sign can be equipped with a computation unit, which manages all current scheduling intervals for all transportation vehicles that have submitted this information, and on the basis of this calculates currently optimized release and closure periods. In some exemplary embodiments this can also involve the passing time or a scheduling interval of only one transportation vehicle.

On the basis of the information supplied by the control unit 6 or the traffic light, the control device 2 of the transportation vehicle can then determine information concerning a driving instruction. In other words, on the basis of the time periods provided, which can also be expressed as switching times, an approach by the transportation vehicle to the road sign can be planned from a time perspective and in a specific configuration of a driving maneuver.

Figure 4:
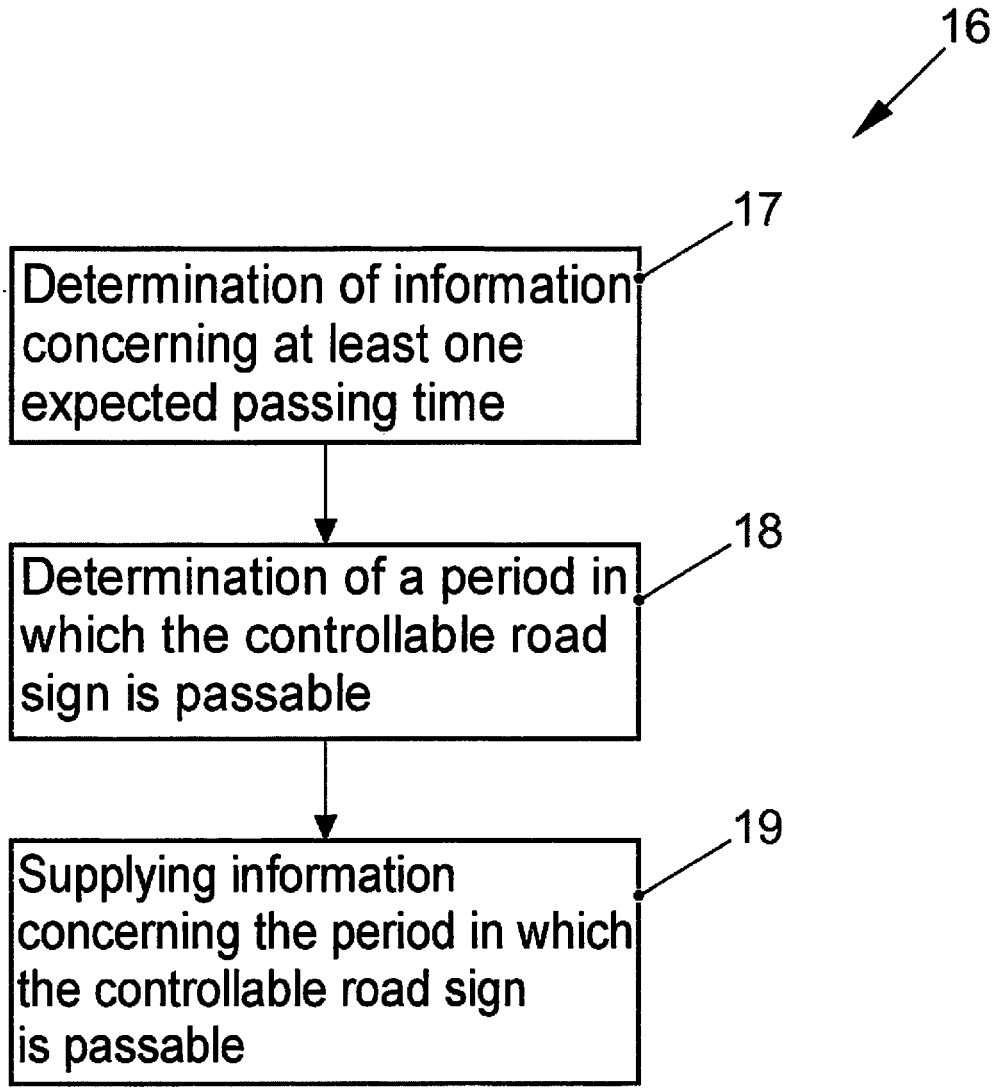
FIG. 4 shows a schematic representation of a method for a control entity for a controllable road sign.

FIG. 4 shows a schematic representation of a method 16 for a control entity for a controllable road sign in accordance with an exemplary embodiment. In the method 16, in a first operation 17 information is determined concerning at least one expected passing time, at which at least one transportation vehicle wants to pass through the controllable road sign. In a further operation 18, a period in which the controllable road sign is passable is determined. Then, in an operation 19 information is supplied concerning the period in which the controllable road sign is passable.

Figure 5:
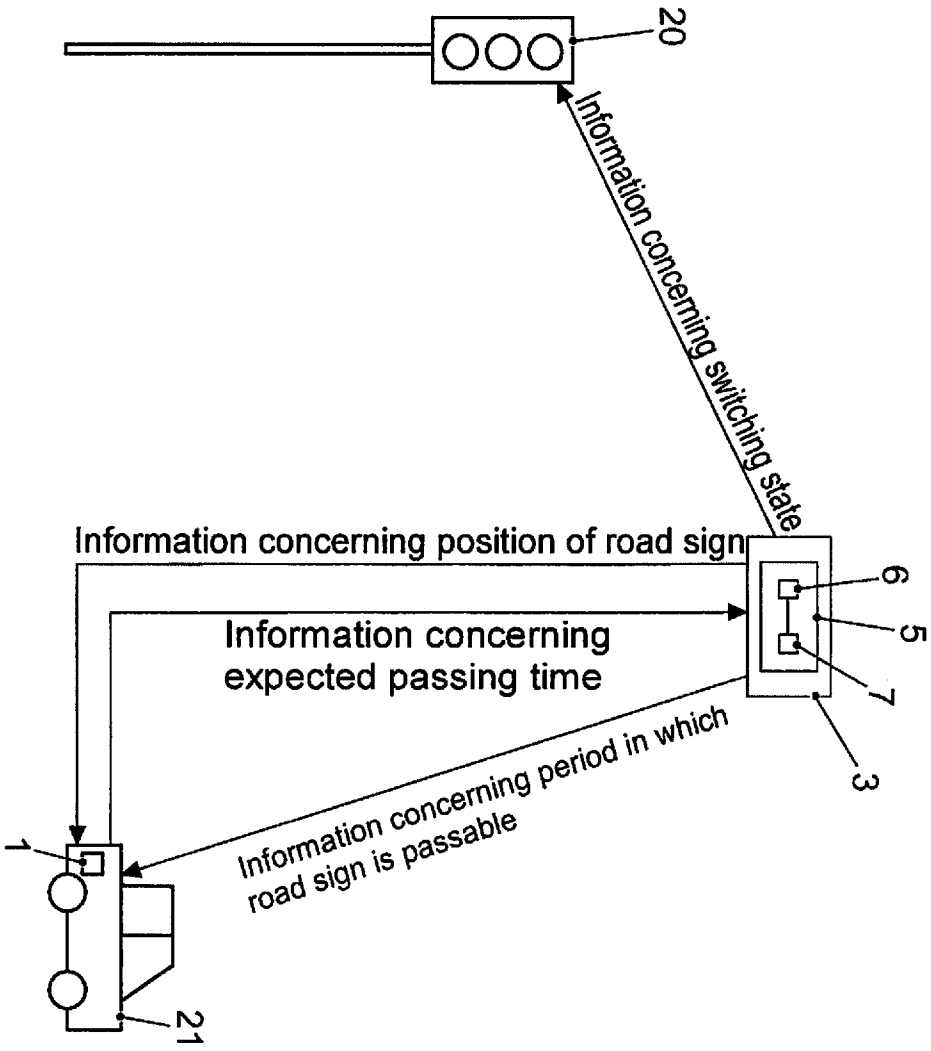
FIG. 5 shows a schematic view of a driving assistance system.

FIG. 5 shows a schematic representation of a driving assistance system 22 in accordance with an exemplary embodiment. A transportation vehicle 21 equipped with the device 1 approaches a controllable road sign 20, for example, a traffic-light controlled intersection with a set of traffic lights. The road sign 20 is assigned the control entity 3 and/or the device 5 for the control entity 3. The control entity 3, or its device 5, is designed to supply information concerning a switching state for the controllable road sign 20. In some exemplary embodiments, the controllable road sign 20 or the control entity 3 and/or the device 5 can be fitted with a Car-2-X wireless technology. The transportation vehicle 21 receives information from the control entity 3 concerning a position of the road sign 20, for example, the position of the traffic lights. For example, using its own navigation systems, the transportation vehicle 21 and/or the device 1 can assign itself to the road sign 20, which can also be designated as a relevant signal group, and can determine a distance to the road sign 20 or a stop line defined by the road sign 20. In other exemplary embodiments, the position can be determined using a map, for example.

By a set desired driving speed, in some exemplary embodiments the control device 2 of the device 1 of the transportation vehicle 21 can determine, for example, calculate or estimate, a time interval in which it would like to pass through the controllable road sign 20 or traffic light intersection. This data is transmitted as information concerning the expected passing time, possibly together with a current position of the transportation vehicle 21 and possibly with information concerning a traffic lane on which it is located, to the control entity 3 and/or the traffic light system, for example, by Car-2-X. In other exemplary embodiments, other variables can also be used to determine the passing time or the time interval, for example, an instantaneous speed or a behavior of at least one transportation vehicle ahead, which can be identified, for example, using radar.

Of course, a plurality of transportation vehicles can be equipped with devices 1. The control entity 3 or even the traffic light can then take into account the information from all transportation vehicles 21 that are equipped with devices 1 and that are currently in communication with the control entity 3, to use this highly up-to-date traffic data to determine information concerning a time period in which the road sign 20 is passable. For this purpose, for example, optimized release and closure periods can be calculated. It may also be possible in some exemplary embodiments to combine a conventional technology for detecting a traffic situation, for example, sensors in the road, with the driving assistance system 22. In some exemplary embodiments this can improve the quality of traffic detection, since transportation vehicles that are not equipped with the device 1 can also be detected or taken into account.

In some exemplary embodiments, different objective functions may be implemented, on the basis of which the controllable road sign 20 can determine its release and closure periods. These objective functions can include, for example, specifications as to the manner in which the traffic flow is to be optimized, for example, in regard to emissions, fuel consumption, traffic flow, noise and/or the like. In some exemplary embodiments, various objective functions can be involved, on the basis of which the control device 2 of a single transportation vehicle 21 plans a crossing, and/or outputs the information concerning the driving instruction. Thus, since a transportation vehicle knows in advance a period or a time window in which a passage or a crossing is possible, in some exemplary embodiments it can perform better energy-saving measures, such as coasting or recuperation. For example, it may be possible that the controllable road sign 20, for example, a signaling system, tries to implement the information concerning the expected passing times that it obtains from the equipped transportation vehicles 21, which can also be designated as preferred crossing intervals, as well as possible. Thus, for example, the sum of the squares of the differences of the scheduled crossing time and the actual crossing time of the individual transportation vehicles could be minimized in the objective function. This may have the consequence that a release time for individual intersection branches can be determined or calculated in a similar way to the volume of a traffic flow on the intersection branch. Among other possibilities, in certain exemplary embodiments however, such a target function can also prevent transportation vehicles on a less busy side branch of an intersection having to wait a disproportionately long time. In addition, in some exemplary embodiments, pedestrian requests can also be taken into account, for example, based on forecasts or heuristics, so that road users that are not equipped with the device 1 can also potentially be incorporated into an optimization of the release and closure periods.

The control entity 3 then communicates the planned period in which the controllable road sign 20 is passable, or the planned release and closure periods, to the transportation vehicles 21 equipped with the device 1. The transportation vehicles 21 can then plan the specific form of their crossing through the traffic-light intersection and if possible, implement it automatically, for example, by an appropriate control of a drive train of the transportation vehicle 21. For example, the control device 2 can output information concerning a driving instruction, wherein the information concerning the driving instruction specifies how a driving behavior of the transportation vehicle 21 is to be adapted for it to pass through the controllable road sign 20 within the period. For example, the drive train can be activated via an interface of a driving assistance system, for example, via a system for automatic distance control (abbr.: ACC system or ADC from: Active Distance Control). The control can take place, for example, by longitudinal control. Longitudinally controlled can mean here, for example, that the device is able to control the speed of the transportation vehicle, for example, by braking and/or accelerating. No automatic steering movements are possible, for example, as in the case of a transverse control mode.

The transportation vehicle 21 in some exemplary embodiments can also obtain information concerning other road users, for example, using transportation vehicle-internal sensors and/or radio messages of the subscribers and/or the control entity 3 of the controllable road sign 20. The information concerning the driving instruction can in some exemplary embodiments be issued based on this information about other road users, and/or the information can also be incorporated in the choice of the driving maneuver to be performed. In some exemplary embodiments an execution of subsequent maneuvers can be initiated, in which the transportation vehicle 21 follows the person in front or a transportation vehicle directly ahead. Here, for example, different strategies can also be implemented. In other exemplary embodiments, other objective functions can also be selected, which underlie the optimization of traffic lights and cars.

In addition, in some exemplary embodiments the information concerning the driving instruction can specify how a driving behavior should be adjusted so that transportation vehicles 21, which are on a traffic lane within the period, pass through the road sign 20 in the same period. For example, transportation vehicles 21 that are located on a traffic lane and have the device 1, can coordinate a joint passage through the road sign 20 or a joint crossing through the intersection. This may be effected, for example, via wireless communication.

The described methods 10 and 16 and/or a corresponding algorithm can run, for example, in a cyclical manner, for example, with a refresh rate of at least 1 Hz, 5 Hz or 10 Hz. As a result, in some exemplary embodiments a change in a switching state of the controllable road sign 20, for example, of the period in which the actual road sign 20 is passable, may be possible at any time or at short notice depending on changes in traffic demand. In addition, in some exemplary embodiments individual transportation vehicles 21 can respond in a highly dynamic way to changes in their environment.

In some exemplary embodiments, the control entity 3 or at least the device 5 can also be spatially assigned to the controllable road sign 20. In other exemplary embodiments, the control entity 3 and/or also the device 5 can be spatially detached from the road sign 20. In some exemplary embodiments the devices 1 and 5 do not then communicate with each other directly. It may also be possible for the data transmission to take place via a plurality of transportation vehicles 21 fitted with the device 1. In other words, in some exemplary embodiments the expected passing time and/or crossing times of the transportation vehicles 21 through the traffic light intersection are not necessarily managed by the traffic light. For example, it may then also be possible that transportation vehicles 21 that have the device 1 determine among themselves a period in which each transportation vehicle 21 can pass through the controllable road sign 20. For example, the transportation vehicles 21 can then agree on and/or communicate a crossing strategy through an intersection.

In some exemplary embodiments the control entity 3 or the road sign 20, for example, in contrast to other road users such as the transportation vehicle 21, may be a central, transportation vehicle-manufacturer independent entity. The control entity 3 can in some exemplary embodiments organize a mandatory traffic control and as a communication partner in the case of a highly complex traffic-related maneuver of a passage through a controllable road sign 20, such as crossing a traffic light, can therefore be selected as a communication partner. In some exemplary embodiments, due to its central position, for example, the control entity 3 can function as an information distribution service between different transportation vehicles 21. In addition, in some exemplary embodiments any pedestrian traffic and any transportation vehicle traffic which is not equipped with the device 1 can be better accounted for if the control entity 3 performs the administration and calculation of the time period in which the transportation vehicle 21 can pass through the road sign 20, which can also be designated as a transportation vehicle passing horizon.

In exemplary embodiments based on the Car-2-X technology, a suitable and adequate range for the function can be obtained. Compared to systems based on cellular radio technology, shorter latency times may potentially be achieved.

In some exemplary embodiments, a maximum volume and maximally balanced flow of traffic can be achieved. In this case, this can involve a so-called traffic light objective function. The specific configuration could be defined in a traffic light objective function. The maximum volume and maximally balanced traffic flow can be based on a universal measure, which all road users and also cities and communities have an interest in increasing. If the time period in which the road sign is passable and/or the release and closure periods are calculated and communicated to the individual transportation vehicles 21, it may be desirable for the transportation vehicles 21 to attempt to reduce their own consumption with the device 1. An additional agreement between the transportation vehicles 21 equipped with the device 1 on a joint crossing may have a positive effect, for example, in regard to a fuel consumption or reduction of emissions.

For example, in some exemplary embodiments such agreements can also be implemented on a manufacturer-independent basis.

In some exemplary embodiments, it is possible for the control entity 3, for example, as a traffic light system, to have highly accurate knowledge concerning a current traffic situation. The quality of this knowledge may increase with an increase in the level of equipment, hence with a number of transportation vehicles 21 that have the device 1 and want to pass through the road sign 20. In some exemplary embodiments, information can also be supplied by conventional technologies for traffic recording, for example, using sensors in a road surface. By providing a sharp increase in the knowledge of the current traffic conditions, a significant improvement in the switching of a traffic light or traffic flow may then be facilitated.

By influencing the switching time of the traffic light or the controllable road sign 20 by the transportation vehicle 21 and the subsequent dynamic calculation or determination of optimal trajectories and/or information concerning a driving instruction, in some embodiments an extended degree of forward planning can be achieved. The information concerning a driving instruction or the determined trajectories can be optimal, for example, for the purposes of differently definable objective functions. In other words, in some embodiments, which can also be referred to as cooperative optimization of a traffic light phase and a transportation vehicle driving maneuver, realistic driving dynamics can be taken into account in the planning of the trajectories and the release times of the traffic lights or road sign 20. This may potentially lead to much more realistic driving maneuvers than is the case in conventional systems. It may be necessary to take into account real-world dynamics to successfully install exemplary embodiments in the transportation vehicle 21.

In exemplary embodiments in which the control entity 3 defines the release times or periods in which the road sign 20 is passable for the individual traffic lanes, the logic can be more intelligent than in some conventional systems, in which a so-called first-come first-served principle is implemented.

In addition, compared to other conventional systems in which for each transportation vehicle request relating to a planned crossing time across the intersection only a "yes" or "no" is returned, in some exemplary embodiments a large number of calculations and requests can be avoided and a passage can be scheduled at an earlier time, which in turn can lead to qualitatively better results. This may be the case, for example, because in the system in accordance with exemplary embodiments, if the answer to a corresponding request with an expected passage time were to be "No", then not only is a "No" communicated but also the entire time horizon which is already blocked is communicated to the device 1 of the transportation vehicle 21. This can be sent either explicitly or at least implicitly, by supplying the period in which the road sign 20 is passable.

In accordance with exemplary embodiments the devices 1 and 5 can be used in all transportation vehicles and traffic lights, which are equipped with the necessary technology. The transportation vehicle 21 can, for example, have a facility for longitudinal control using driving assistance systems, for example, distance controls (such as ACC), a hardware for a radio-based communication with the control entity 3 and/or other road users, for example, based on the Car-2-X standard. For example, the transportation vehicle can have a self-locating the transportation vehicle, for example, via GPS, and a computing unit, which can comprise the device 1. The road sign 20 or traffic light system can also be equipped with the necessary radio technology, as well as with a corresponding computation unit for managing the transportation vehicle requests and signal state optimization, for example, the control entity 3.

Depending on the specific implementation requirements, exemplary embodiments can be implemented either in hardware or in software. The implementation can be carried out by using a digital storage medium, such as a floppy disk, a DVD, a Blu-Ray disc, a CD, a ROM, a PROM, or an EPROM, EEPROM or Flash memory, a hard disk or other magnetic or optical storage, on which electronically readable control signals are stored, which can interact with a programmable hardware component, or interact in such a way that the respective method is carried out.

A programmable hardware component can be formed by a processor, a computer processor (CPU=Central Processing Unit), a graphics processing unit (GPU=Graphics Processing Unit), a computer, a computer system, an application-specific integrated circuit (ASIC), an integrated circuit (IC), a single-chip system (SOC=System-on-Chip), a programmable logic element or a field-programmable gate array (FPGA) with a microprocessor.

The digital storage medium can therefore be machine- or computer-readable. Some exemplary embodiments thus comprise a data carrier, which has electronically readable control signals that are capable of interacting with a programmable computer system or a programmable hardware component, in such a way that one of the methods described herein is carried out. At least one exemplary embodiment therefore is a data carrier (or a digital storage medium or a computer-readable medium), on which the program is recorded for carrying out one of the methods described herein.

In general, exemplary embodiments can be implemented as software, firmware, computer program or computer program product with a program code or as data, wherein the program code is, or the data are, effective in terms of carrying out one of the methods if the program is running on a processor or a programmable hardware component. The program code or the data can also be stored, for example, on a machine-readable medium or data carrier. The program code or the data can exist as source code, machine code or byte code, among other things, as well as other intermediate code.

A program in accordance with at least one exemplary embodiment can implement one of the methods during its implementation, for example, by the program reading out memory locations or writing a datum or plurality of data into these locations, which enables switching operations or other operations to be invoked in transistor structures, in amplifier structures or in other electrical, optical, magnetic components or components operating according to another functional principle. Accordingly, by reading from a memory location, signals data, values, sensor values or other information can be recorded, determined or measured by a program. By reading out one or more memory locations, a program can therefore detect, determine or measure variables, values, measurement variables and other information, and can also by writing to one or more memory locations perform, initiate or implement an action, and also control other equipment, machinery and components.

The exemplary embodiments and their individual features disclosed in the present description, the claims and the attached figures can be of significance and implemented both individually as well as in any desired combination to realize an exemplary embodiment in its various configurations. In some other exemplary embodiments, features which in other embodiments are disclosed as a device feature can also be implemented as method features. Also, where appropriate, features which in some exemplary embodiments are implemented as method features can be implemented in other embodiments as device features.

LIST OF REFERENCE NUMERALS

1 device
2 control device
3 control entity
4 receiving and transmitting device
5 device
6 control device
7 receiving and transmitting device
10 Method
11 Determining
12 Determining
13 Identification
14 Supplying
15 Receiving
16 Method
17 Determining
18 Determining
19 Supplying
20 controllable road sign
21 transportation vehicle
22 driving assistance system

The invention claimed is:

1. A device for a driving assistance system of a transportation vehicle, the device comprising:

a control device configured to:

determine a position of a controllable road sign at a traffic-controlled intersection, determine a position of the transportation vehicle, determine a speed and/or an acceleration of at least one transportation vehicle directly ahead, and determine, based on the position of the transportation vehicle, the position of the controllable road sign and the speed and/or the acceleration of the at least one transportation vehicle directly ahead, at least one expected passing time at which the transportation vehicle is expected to pass the traffic-controlled intersection of the controllable road sign; and a receive and transmit device configured to:

transmit, to a control entity controlling the controllable road sign, the at least one expected passing time, receive, from the control entity, a passable time at which the traffic-controlled intersection of the controllable road sign is passable prior to a change in a switching state of the controllable road sign, wherein the passable time has been adjusted to correspond to the at least one expected passing time, and wherein the control device further issues, in response to receiving the passable time, a driving instruction to the driving assistance system specifying how a driving behavior of the transportation vehicle is to be adjusted to pass the traffic-controlled intersection of the controllable road sign according to the at least one expected passing time and prior to the change in the switching state of the controllable road sign.

2. The device of claim 1, wherein the control device determines a planned route of the transportation vehicle and determines the at least one expected passing time, based on the planned route.

3. The device of claim 1, further comprising a user interface configured to display an interface output based on the passable time.

4. The device of claim 1, wherein the control device is configured to update the at least one expected passing time.

5. A device for a control entity controlling a controllable traffic light system disposed at a traffic-controlled intersection, the device comprising:

a control device configured to, in response to receiving, from at least one transportation vehicle, at least one expected passing time at which the at least one transportation vehicle expects to pass through the traffic-controlled intersection of the controllable traffic light system, transmit, to the at least one transportation vehicle, a passable time at which the traffic-controlled intersection of the controllable traffic light system is passable prior to a change in a switching state of the controllable road sign, wherein the passable time has been adjusted to correspond to the at least one expected passing time, wherein the at least one expected passing time is based on a position of the transportation vehicle, a position of the controllable traffic light system, and a speed and/or an acceleration of at least one other transportation vehicle located directly ahead of the at least one transportation vehicle, identify an increase in traffic flow at the traffic-controlled intersection of the controllable traffic light system, and modify a release or closure time prior to the change in the switching state of the controllable traffic light system based on the passable time in response to the identified increase in traffic flow.

6. The device of claim 5, wherein the control device receives the at least one expected passing time from a plurality of transportation vehicles.

7. The device of claim 5, further comprising a receiving and transmitting device, wherein the receiving and transmitting device receives the at least one expected passing time using wireless data transmission and/or transmits the passable time using wireless data transmission.

8. A method for a driving assistance system of a transportation vehicle, the method comprising:

determining, by the driving assistance system of the transportation vehicle, a position of a controllable road sign disposed at a traffic-controlled intersection;

determining a position of the transportation vehicle;

determining a speed and/or an acceleration of at least one other transportation vehicle driving directly ahead of the transportation vehicle;

identifying, based on the position of the controllable road sign, the position of the transportation vehicle, and the speed and/or the acceleration of the at least one other transportation vehicle driving directly ahead, at least one expected passing time at which the transportation vehicle is expected to pass the traffic-controlled intersection of the controllable road sign;

transmitting, to a control entity controlling the controllable road sign, the at least one expected passing time;

receiving, from the control entity, a passable time at which the traffic-controlled intersection of the controllable road sign is passable prior to a change in a switching state of the controllable road sign, wherein the passable time has been adjusted to correspond to the at least one expected passing time; and issuing, in response to receiving the passable time, a driving instruction to the driving assistance system specifying how a driving behavior of the transportation vehicle is to be adjusted to pass the traffic-controlled intersection of the controllable road sign according to the at least one expected passing time and prior to the change in the switching state of the callable road sign.

9. A method for a control entity controlling a controllable traffic light system disposed at a traffic-controlled intersection, the method comprising:

determining, by the control entity and based on communications sent by at least one transportation vehicle, at least one expected passing time at which the at least one transportation vehicle expects to pass through the traffic-controlled intersection of the controllable traffic light system, wherein the at least one expected passing time is based on a position of the transportation vehicle, a position of the controllable traffic light system, and a speed and/or an acceleration of at least one other transportation vehicle located directly ahead of the at least one transportation vehicle;

determining a passable time at which the traffic-controlled intersection of the controllable traffic light system is passable prior to a change in a switching state of the controllable road sign, wherein the passable time has been adjusted to correspond to the at least one expected passing time;

transmitting, to the transportation vehicle, the passable time;

identifying an increase in traffic flow at the traffic-controlled intersection of the controllable traffic light system; and modifying a release or closure time prior to the change in the switching state of the controllable traffic light system based on the passable time in response to the identified increase in traffic flow.

10. A non-transitory computer readable medium storing a program implemented with a program code for implementing a method for a driving assistance system of a transportation vehicle when the program code is executed on a computer, a processor, a control module or a programmable hardware component, the method comprising:

determining, by the driving assistance system, a position of a controllable road sign disposed at a traffic-controlled intersection;

determining a position of the transportation vehicle;

determining a speed and/or an acceleration of at least one other transportation vehicle driving directly ahead of the transportation vehicle;

identifying, based on the position of the transportation vehicle, the position of the controllable road sign, and the speed and/or the acceleration of the at least one other transportation vehicle directly ahead, at least one expected passing time at which the transportation vehicle is expected to pass a traffic-controlled intersection of the controllable road sign;

transmitting, to a control entity controlling the controllable road sign, the at least one expected passing time;

receiving, form the control entity, a passable time at which the traffic-controlled intersection of the controllable road sign is passable prior to a change in a switching state of the controllable road sign, wherein the passable time period has been adjusted to correspond to the at least one expected passing time; and issuing, based on the at least one expected passing time, a driving instruction to the driving assistance system specifying how a driving behavior of the transportation vehicle is to be adjusted to pass the traffic-controlled intersection of the controllable road sign at the at least one expected passing time and prior to the change in the switching state of the controllable road sign.

* * * * *